US005502914A

United States Patent [19]

Moon

[11] Patent Number: 5,502,914

[45] Date of Patent: Apr. 2, 1996

[54] STRIKER COCKING AND FIRING MECHANISM FOR A HANDGUN

[76] Inventor: Kook-Jin Moon, 630 Rte. 303, Blauvelt, N.Y. 10913

[21] Appl. No.: 81,169

[22] Filed: Jun. 25, 1993

[51] Int. Cl.[6] ..... F41A 19/32

[52] U.S. Cl. ..... 42/69.02

[58] Field of Search ..... 42/69.02, 69.01, 42/70.08, 70.06, 69.03; 89/136, 149, 27.14, 147, 154

[56] References Cited

U.S. PATENT DOCUMENTS

| | | | |
|---|---|---|---|
| 2,813,362 | 11/1957 | Sunderland | 42/69.02 |
| 3,163,951 | 1/1965 | Lewis . | |
| 3,678,800 | 7/1972 | Seidel et al. | 89/147 |
| 3,722,123 | 3/1973 | Pavisi | 42/16 |
| 5,157,209 | 10/1992 | Dunn | 89/154 |
| 5,179,233 | 1/1993 | du Plessis | 42/69.02 |

FOREIGN PATENT DOCUMENTS

| | | | |
|---|---|---|---|
| 79574 | 9/1950 | Czechoslovakia | 42/69.02 |

*Primary Examiner*—Stephen M. Johnson

[57] ABSTRACT

A handgun with a striker cocking and firing mechanism which features a cocking cam to move a striker by motion of the trigger bar imparted to it by the trigger.

15 Claims, 6 Drawing Sheets

STRIKER COCKING AND FIRING MECHANISM FOR A HANDGUN

FIELD OF THE INVENTION

This invention relates primarily to firearms and more particularly to a compact striker cocking and firing mechanism for a semi-automatic handgun or pistol.

BACKGROUND OF THE INVENTION

A typical handgun of the type with which the present invention is concerned comprises a semi-automatic, hand-held pistol which may include a breech-locking mechanism. In such a typical breech locking firearm cartridges fed from a magazine by spring pressure move upwardly in the column, each time a cartridge is fired by the gun. To load the cartridge into the chamber, a slide is pulled back with one hand, while holding the handle of the gun with the other hand. When the slide is pulled back, the barrel of the gun moves on a camway, serving to rotate the barrel slightly to thereby release the barrel from a lock, which in turn, serves to interlock the slide of the gun to the breech end of the barrel. Thus, the slide is moved back independently and then released to go forward under the bias of a recoil spring. A tongue depending from the slide catches the back of the first or uppermost cartridge in the magazine and pushes it forward into the chamber. Thereafter, when the trigger is pulled, a firing mechanism releases a firing pin to strike the primer portion of a loaded cartridge and thereby discharge the firearm. The function of the primer is to ignite the powder which is stored inside the cartridge, causing expanding gases in the cartridge to push the bullet (nose of the cartridge) out through the barrel. According to the laws of physics, an equal and opposite force pushes the slide rearwardly causing an extractor to pull the empty cartridge case out of the chamber and an ejector to propel the empty cartridge case out of the side of the gun. The return stroke of the slide (caused by the bias of the recoil spring) enables the depending tongue to catch the back of the next cartridge in the magazine and load it into the chamber. This cycle is repeated each time the trigger is pulled and until the magazine is emptied.

Although the invention concerns improvements intended primarily for use in connection with small semi-automatic firearms, the invention described herein has utility in other types of firearms, as well. Therefore, all aspects of the present invention should not only be considered as extending to the type of firearm illustrated, but also to other types of firearms.

Of course, the design of hand guns, in striving for optimum design, in recent years has moved to fewer moving parts to thereby make the firearm more reliable. With fewer moving parts, there is less chance of failure of such parts, and more reliability and efficacy of the design results.

Still further, with fewer moving parts, the hand gun becomes more compact leading to a more comfortable usage thereof, with the ability to conceal the hand gun for self-defense purposes.

A typical area in a hand gun in which compactness resulting from fewer moving parts can be attained is the cocking and firing mechanism. This cocking and firing mechanism design also provides smooth trigger pull.

Various hand guns designs have been shown in the patent literature, for instance, the design shown by du Piessis, U.S. Pat. No. 5,179,233; and Lewis U.S. Pat. No. 3,163,951.

Neither of these patents indicates or teaches the advances in the design of the striker cocking and firing mechanism, as is attained by the present invention.

OBJECTS OF THE INVENTION AND SUMMARY OF THE INVENTION

Accordingly a primary object of the present invention is to provide an improved compact striker cocking and firing mechanism for a firearm.

A further object of the present invention is to provide a striker cocking and firing mechanism of compact design which provides a smooth trigger pull and a single pull action for cocking and releasing the firing pin.

These and other objects of the invention are provided in a hand gun featuring a mechanism, which includes a trigger attached to a trigger bar which operates a cocking and releasing element to move a striker rearwardly of the hand gun to a to a fully-cocked position and release the striker to move forwardly of the hand gun, under spring pressure, to thrust through the hole in the breech face of the hand gun in order to detonate a loaded cartridge primer.

Other objects, features and advantages of the present invention will become apparent by reference to the following detailed description of the preferred, but nonetheless illustrative, embodiment, with reference to the accompanying drawings, wherein.

DETAILED DESCRIPTION OF THE PREFERRED EMBODIMENT

Figure 1:
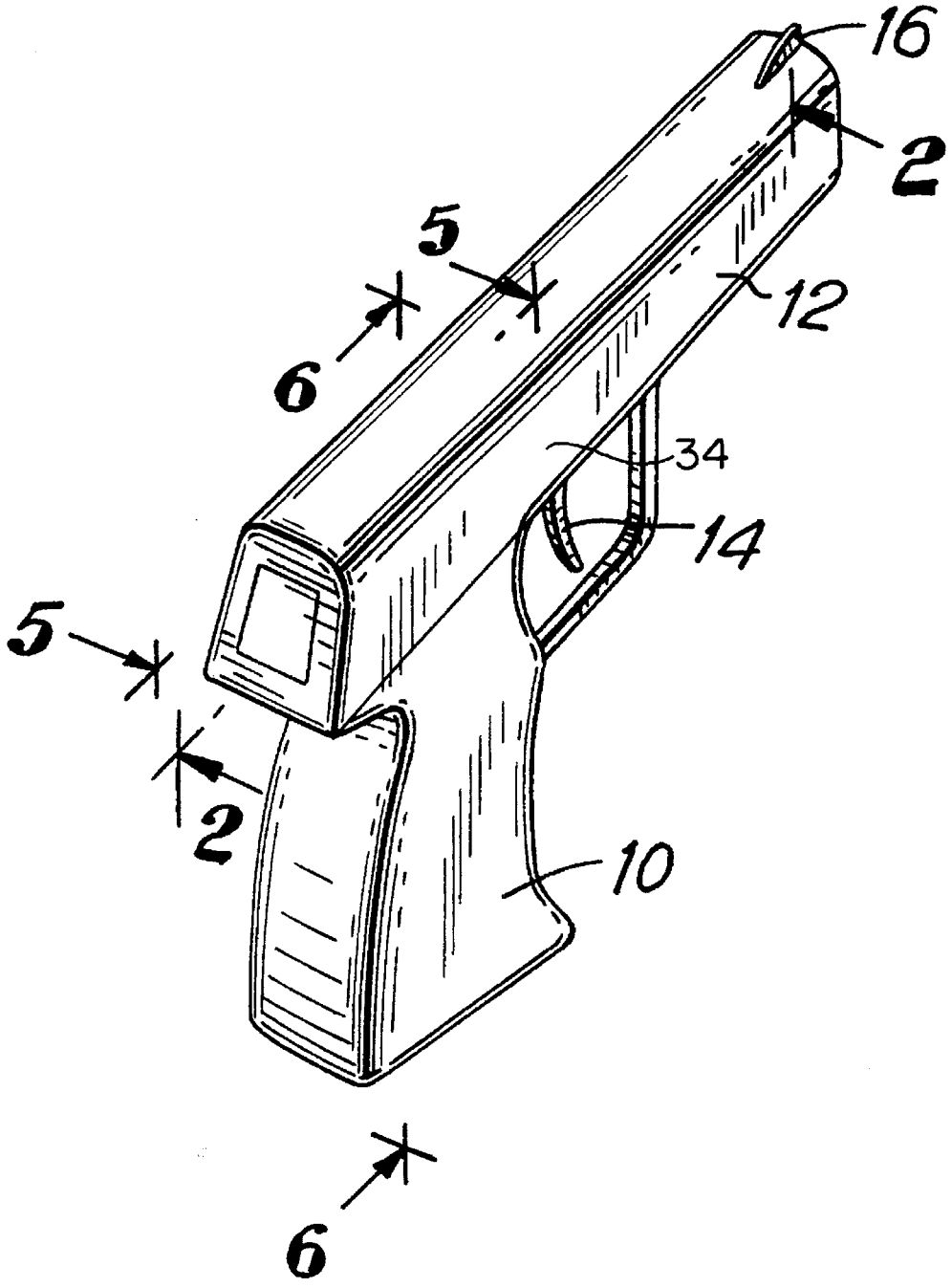
FIG. 1 is a rear, top and left side perspective view of a handgun employing the mechanism of the present invention.
Figure 2:
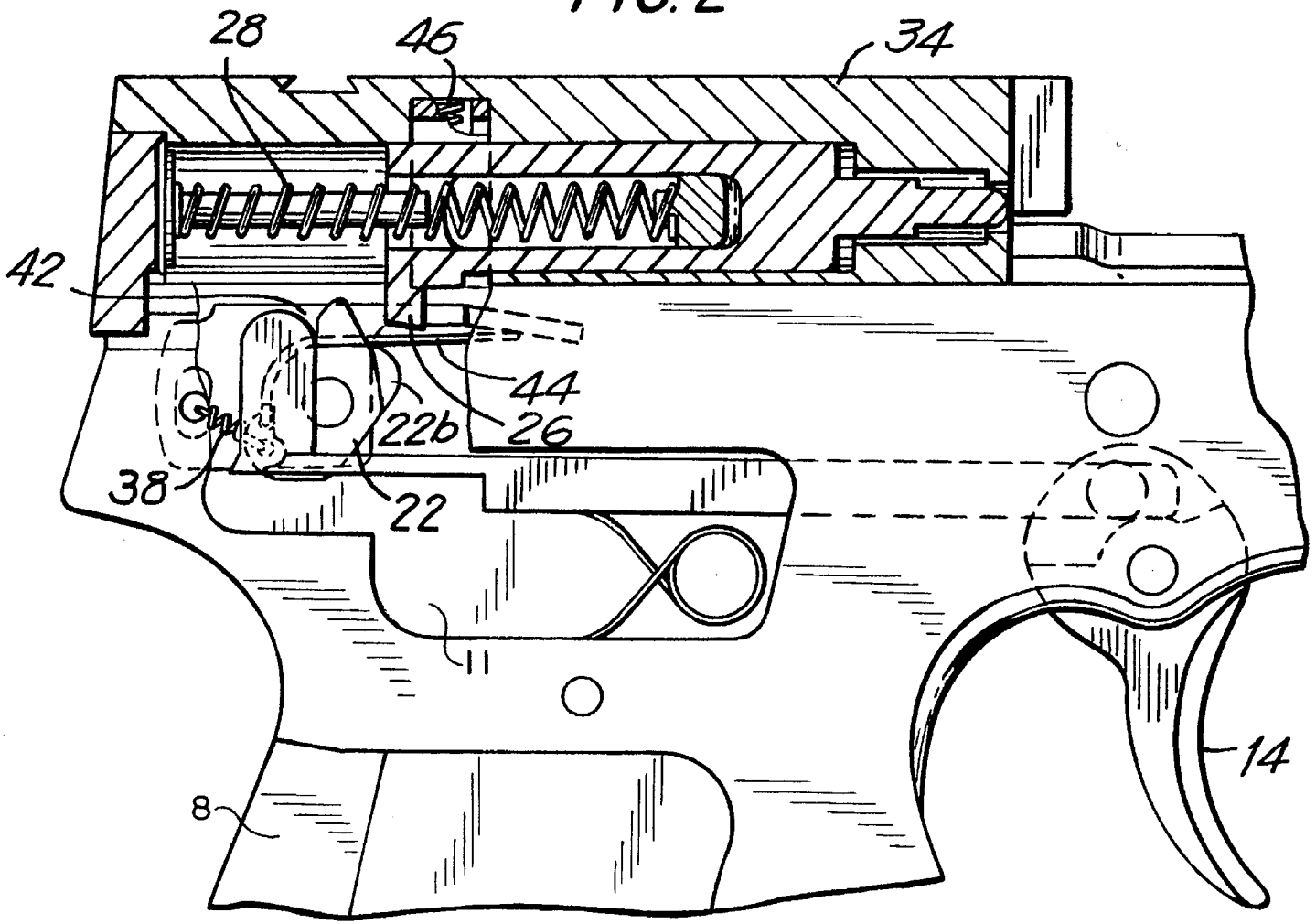
FIG. 2 is a fragmentary left side elevational view shown partially in section taken along the line 2—2 of FIG. 1 and showing particularly the gun frame, the cocking and releasing cam, the striker and the slide mechanism, the striker being in uncocked position.

FIGS. 1 and 2 show a handgun embodying the invention and having a frame 8 defining a receiver 11 (FIG. 2), a handle 10, a barrel 12 and a trigger 14. The handle is located at the rear end of the gun, and the sight 16 and barrel opening (not shown) are located at the forward end of the gun. When the gun is in its uncocked or inactive condition the mechanism of the present invention, as it will be described, is at rest with the positions of the various elements as illustrated in FIG. 2.

Figure 4:
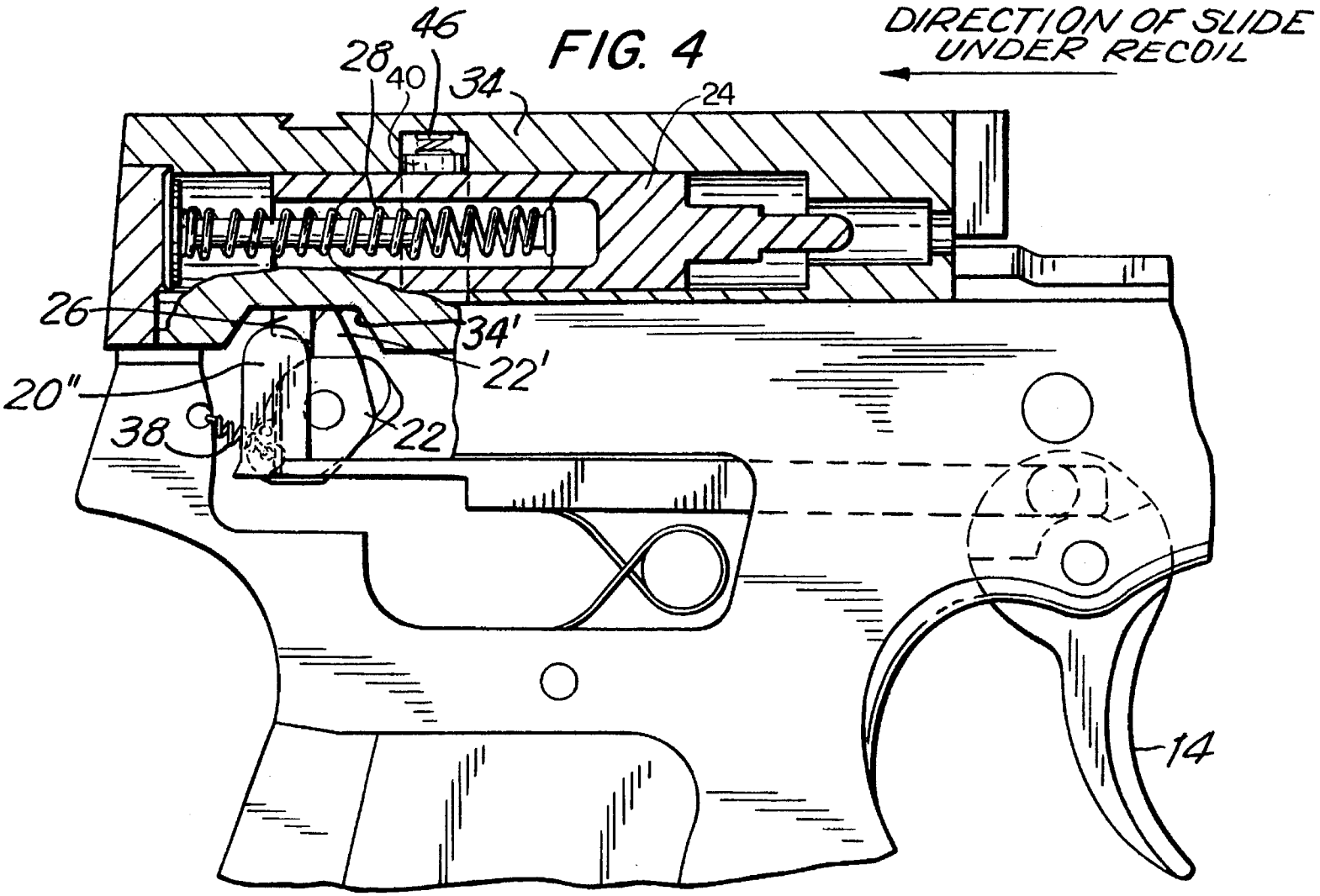
FIG. 4 is a view similar to that shown in FIGS. 2 and 3 but shows the striker in a half-cocked position.
Figure 5:
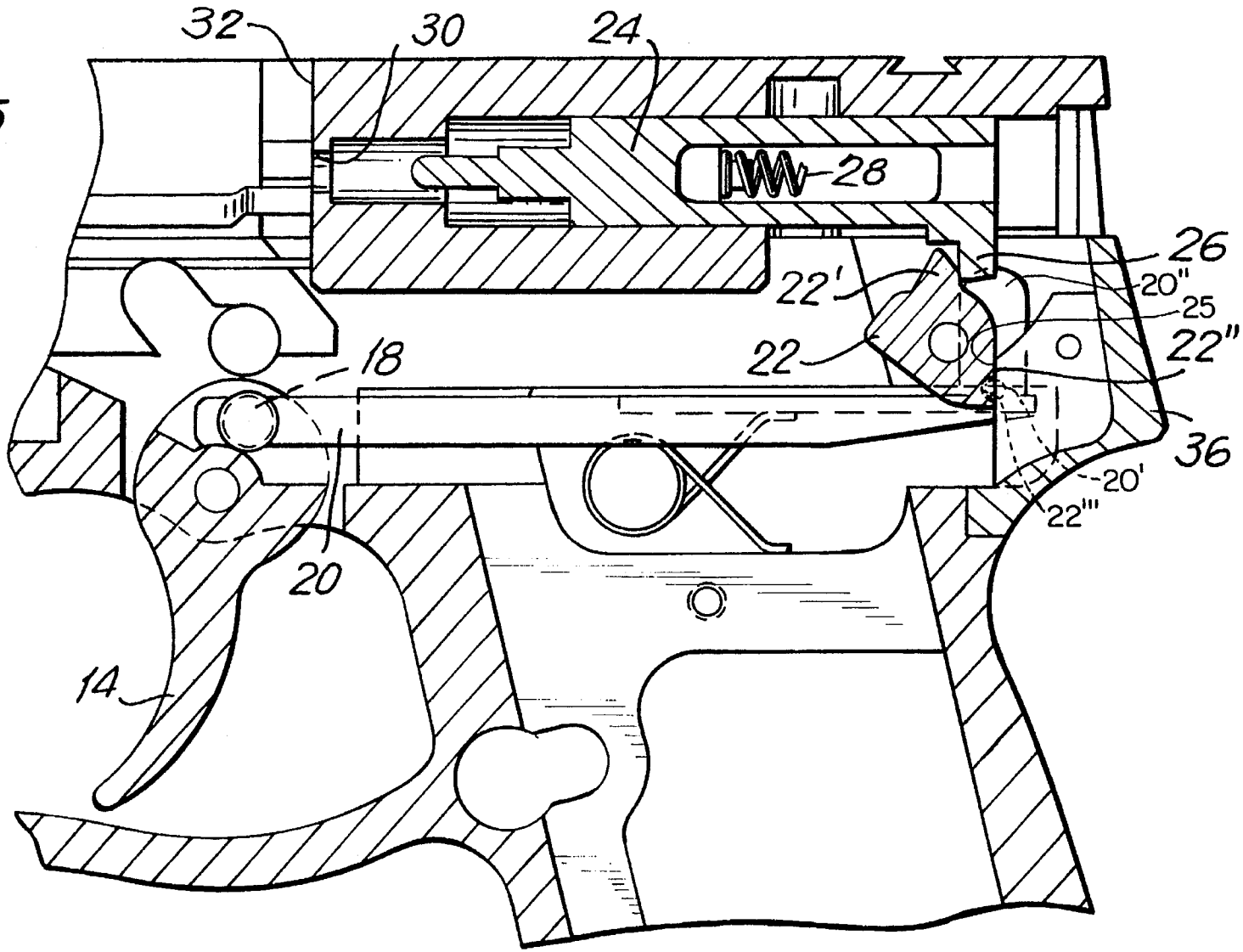
FIG. 5 is a fragmentary right side, sectional view taken along the line 5—5 of FIG. 1 with the striker shown in half-cocked position.

Referring to FIG. 5, trigger 14 is pivotally connected by means of pin 18 to trigger bar 20. The function of trigger bar 20 is to rotate the cocking and releasing element or cam 22, which in turn moves the striker 24, by means of the cam's engagement with tongue 26 of striker 24. This action of cam 22 moves striker 24 rearwardly from its half-cocked position, shown in FIGS. 4 and 5, to a fully-cocked position shown in FIG. 3, after which the cam 22 releases the striker 24 to move forward to a striking position corresponding to a discharging position of the firing mechanism, under the pressure of spring 28. In the striking or discharging position the striker 24 protrudes through a hole 30 defined by breech face 32.

The uncocked position of the handgun is as illustrated in FIG. 2, with slide 34 in the forward position shown in that drawing. As the cycle of operation proceeds from the uncocked position of FIG. 2, the elements of the firing mechanism of this invention move to the half-cocked position, shown in FIGS. 4 and 5, as the slide 34 is pulled back to its retracted position (not shown) and then released. This pulling and releasing action of slide 34 loads a cartridge into the firing chamber (not shown) and positions the tongue 26 of striker 24 behind the first cam lobe 22' of cam 22. In the half-cocked position the striker 24 does not possess, in theory, enough energy to detonate the primer if it releases at that point. Referring again to FIG. 5, striker tongue 26 rests on the first cam lobe 22' of cam 22; and the cam 22 is prevented from rotating in a counterclockwise direction from its first position, in which it appears in FIG. 5, by an abutment surface 22" on the cam 22 which engages an arresting surface 25 on the frame back piece 36.

Figure 3:
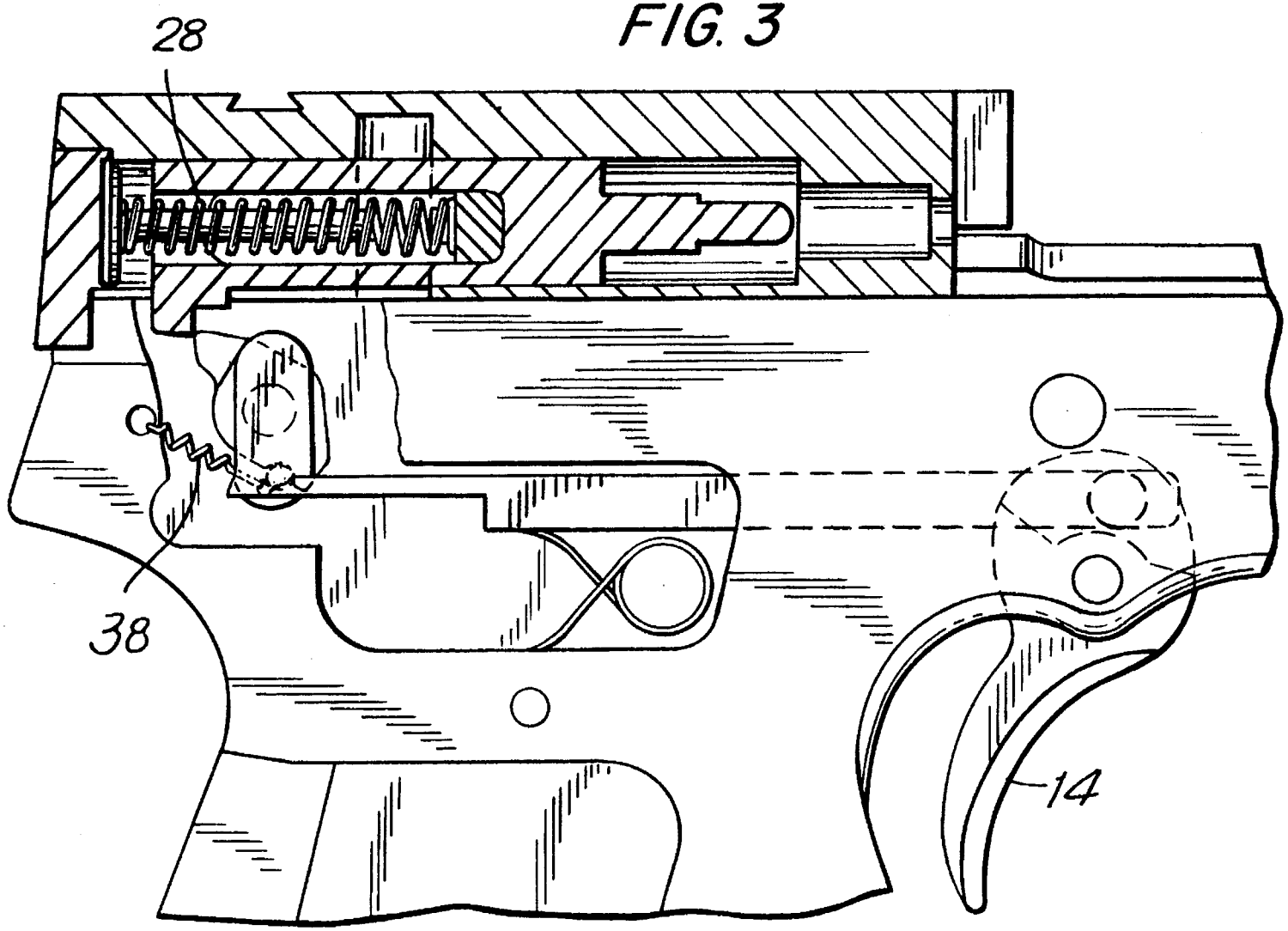
FIG. 3 is similar to FIG. 2, but shows the striker in its fully cocked position at the point of release.

Further referring to FIG. 5, the elements which comprise the firing mechanism move as trigger 14 is pulled to impart forward motion to trigger bar 20 which rotates the cocking and releasing cam 22 in a clockwise direction to drive the striker 24 rearwardly from its half-cocked position to its fully cocked position before it is released by the cam 22 in the position generally shown in FIG. 3.

As the trigger is pulled beyond the position shown in FIG. 3, the first cam lobe 22' of the cocking and releasing cam 22 disengages from the striker tongue 26 (at the point shown in FIG. 3), freeing the striker 24 to move forward under pressure of spring 28 to detonate a loaded cartridge primer, which abuts breech face 32.

Figure 6:
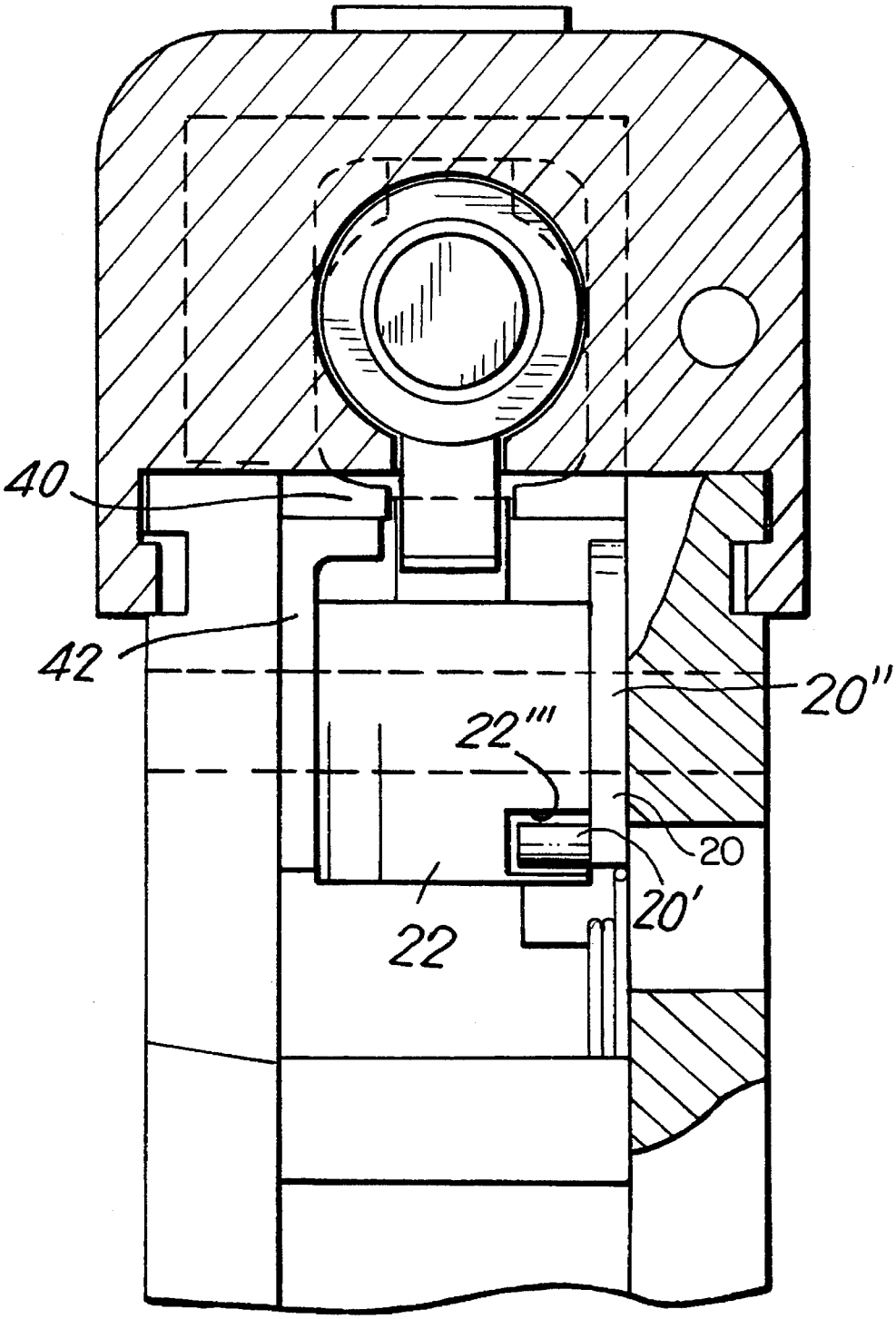
FIG. 6 is a somewhat enlarged rear view, shown partially in section, taken along the line 6—6 of FIG. 1 and showing particularly the safety blocker for the striker.

In the rear view of FIG. 6, trigger bar 20 moves cocking cam 22 by means of a horizontal protrusion 20' that locates in a recess 22" defined by the cocking and releasing cam body 22. While the trigger 14 is being pulled, trigger bar protrusion 20' remains in the recess 22" of cam 22. However, after striker 24 is released and the loaded cartridge is detonated, slide 34 moves rearwardly under recoil and toward its retracted position. A cam surface 34' on the rearwardly moving slide engages a trigger bar cam 20" to pivot the trigger bar 20 downwardly and move the protrusion 20' out of the recess 22", thereby disconnecting the trigger bar 20 from the cam 22. This releases the cocking and releasing cam 22, allowing the cam 22 to spring back to its first position, under the bias of spring 38. As the slide moves forwardly on its return stroke, striker tongue 26 catches the first cam lobe 22' of cam 22. The trigger bar cam 20" springs back into place in a cut-away in slide 34 partially defined by the cam surface 34', and illustrated in FIG. 4. The gun is now ready to fire the next round.

A striker safety device 40 (FIG. 6) is used in the mechanism to block striker 24 until lever 42 (FIGS. 2, 6), which is lifted by a second cam lobe **22*b* on the cam 22 (FIG. 2) and a spring 44, lifts safety device 40 upwardly. This allows for free passage of striker 24, so that it travels by inertia all the way forwardly to its striking position wherein it protrudes through hole 30 defined by the breech face to discharge the firearm. Camming lobe 22*b* is angularly offset from the first cam lobe 22" and thereby timed so that the safety device 40 is released at the last moment before striker 24 is released to fire the cartridge. At all other times, the safety block 40 is on and held in position by spring 46 as shown in FIG. 4**.

It will now be apparent that the aforedescribed gun has a double action and that pulling the trigger both cocks and releases the striker. The cocking and releasing cam also serves as a striker block when the striker is in its half-cocked position so that the striker cannot escape from the latter position unless the trigger is pulled.

It should be noted that the pivotal axis of the cocking and releasing cam is located generally centrally of the cam. The first cam lobe 22' is centered generally vertically above the cam pivotal axis and the abutment surface 22" is located below the cam pivotal axis when the cam is in its first or full line position of FIG. 5. Thus, the abutment surface 22" located below the cam axis provides positive resistance to pivotal movement of the cam in a counter-clockwise direction from its position of FIG. 5 and the upper portion of the cam or first lobe 22' cooperates with the tongue 26 to block movement of the striker 24 towards its striking position.

The vertical alignment of the first cam lobe 22' with the pivotal axis of the cam in its first position provides an important safety feature, because the angular movement of the cam (over 60° ) which is required to move the striker to and release it in its fully-cocked position is too great a movement to result from dropping the gun. It will also be noted that the biasing forces of the springs 28 and 38 which exert counterclockwise biasing force on the cam cooperate with the arresting surface on the frame to retain the cam with its first cam lobe 22' in vertically oriented or striker blocking position. The latter springs also resist rotation of the cam in the event that the gun is dropped. Further, since the pivotal axis of the cam is located generally centrally of the cam the weight of the cam is roughly evenly distributed about the cam axis so that dropping the gun is not likely to induce rotation of the cam due to its own inertia.

A long trigger pull is required to produce the necessary angular displacement of the cocking and releasing cam (over 60° ) necessary to move the striker from its half-cocked to its fully-cocked and releasing position. During this cam movement the first cam lobe 22' moves both in vertical and horizontal directions as the cam travels along its rotational arc to move the cocking cam from its half-cocked to its fully-cocked and released positions against the biasing force of the spring 28. The aforedescribed features result in an inherently safe firing mechanism.

The foregoing represents an illustrative mechanism for the present invention, but is not to be considered as a limitation for the breadth thereof, which limitation is to be provided only by the following claims:

What is claimed is:

1. A firearm comprising a frame defining a receiver, a slide supported for reciprocal sliding movement on and relative to the frame between forward and retracted positions, and a firing mechanism for discharging said firearm and including a striker supported by the slide for movement with the slide and relative to the frame and for movement relative to the slide between a fully-cocked position and a striking position, said striking position corresponding to the discharging position of said firearm, first biasing means for urging said striker toward said striking position, a cocking and releasing element supported on the frame within the receiver for movement between first and second positions, second biasing means for urging said cocking and releasing element towards its first position, a trigger assembly for engaging and moving said cocking and releasing element from its first to its second position and including a trigger moveable from an inactive position to a firing position, said striker being moveable into engagement with said cocking and releasing element in said first position and to a half-cocked position intermediate said fully-cocked position and said striking position in response to movement of said slide from said retracted position toward said forward position, said cocking and releasing element in said first position maintaining said striker in said half-cocked position, said striker being moveable from said half-cocked position to said fully-cocked position and releasable from said fully-cocked position for movement to said striking position in response to movement of said trigger to said firing position, and disconnecting means for disengaging said trigger assembly from said cocking and releasing element after said striker has been released by said cocking and releasing element and in response to movement of said slide to said retracted position.

2. A firearm as set forth in claim 1 wherein said trigger assembly includes a trigger bar connected to said trigger and engageable with said cocking and releasing element and said disconnecting means includes a trigger bar cam carried by said trigger bar and a cam surface on said slide for engaging said trigger bar cam.

3. A firearm as set forth in claim 2 wherein said trigger bar is pivotally connected to said trigger and said cocking and releasing element is supported for angular movement relative to said frame.

4. A firearm as set forth in claim 1, wherein said striker has a depending tongue and said cocking and releasing element comprises a cocking and releasing cam supported for angular movement by and relative to said frame and said cocking and releasing cam has a first cam lobe for engaging said tongue.

5. A firearm as set forth in claim 1, wherein said cocking and releasing element comprises a cocking and releasing cam having a recess therein and supported for angular movement relative to said frame and said trigger assembly is engageable with said cocking and releasing cam within said recess.

6. A firearm as set forth in claim 5 wherein said trigger is pivotally supported on said frame and said trigger assembly includes a trigger bar pivotally connected to said trigger and engageable with said cocking and releasing element.

7. A firearm as set forth in claim 1 including a blocking member supported for movement between a blocking position wherein said striker is secured against movement to said striking position and a releasing position wherein said striker is freed by said blocker for movement to said striking position, third biasing means for urging said blocking means toward said blocking position and releasing means for moving said blocking means to said releasing position as said cocking and releasing member approaches said second position in response to the movement of said trigger toward its firing position.

8. A firearm as set forth in claim 1 wherein said flame has an arresting surface thereon and said cocking and releasing element has an abutment surface for engaging said arresting surface when said cocking and releasing element is in its first position to maintain said cocking and releasing element in its first position.

9. A firearm comprising a frame defining a receiver, a slide supported for reciprocal sliding movement on and relative to the frame between forward and retracted positions, a striker supported on the slide for movement relative to the slide between fully-cocked and striking positions, first biasing means for urging the striker toward said striking position, a cocking and releasing cam supported for angular movement on the frame and within the receiver between first and second positions, said cocking and releasing cam having angularly spaced apart first and second cam lobes and a recess therein, a trigger assembly including a trigger supported on the frame for angular movement between inactive and firing position, a trigger bar pivotally connected to said trigger and engageable with said cocking and releasing cam within said recess, said trigger bar being engaged with said cocking and releasing cam when said cam is in its first position and during the travel of said cam from said first position to said second position, disconnecting means for disengaging said trigger bar from said cocking and releasing cam in response to the movement of said slide toward its retracted position after said cocking and releasing cam reaches its second position, second biasing means for urging said cocking and releasing cam toward its first position, a blocking member supported for movement between a blocking position wherein said striker is secured against movement to said striking position and a releasing position wherein said striker is free to move to its striking position, and third biasing means for urging said blocker toward its blocking position, said striker being moveable into engagement with said cocking and releasing cam in its first position and to a half-cocked position intermediate said fully-cocked and said striking position, said cocking and releasing cam in its first position maintaining said striker in its half-cocked position, said first cam lobe moving said striker to and releasing it in its fully-cocked position in response to the movement of said cocking and releasing cam to its second position, said second cam lobe moving said blocker to said releasing position as said first cam lobe approaches its second position.

10. A firearm comprising a frame defining a receiver, a slide supported for reciprocal sliding movement on and relative to the frame between forward and retracted positions, and a firing mechanism for discharging said firearm and including a striker supported by the slide for movement with the slide and relative to the frame and for movement relative to the slide between a fully-cocked position and a striking position, said striking position corresponding to the discharging position of said firearm, first biasing means for urging said striker toward said striking position, a cocking and releasing element supported on the frame within the receiver for movement between first and second positions, second biasing means for urging said cocking and releasing element towards its first position, a trigger assembly for engaging and moving said cocking and releasing element from its first to its second position and including a trigger moveable from an inactive position to a firing position, said striker being moveable into engagement with said cocking and releasing element in said first position and to a half-cocked position intermediate said fully-cocked position and said striking position in response to movement of said slide from said retracted position toward said forward position, said cocking and releasing element in said first position maintaining said striker in said half-cocked position, said striker being moveable from said half-cocked position to said fully-cocked position and releasable from said fully-cocked position for movement to said striking position in response to movement of said trigger to said firing position, and a blocking member supported for movement between a blocking position wherein said striker is secured against movement to said striking position and a releasing position wherein said striker is freed by said blocking member for movement to said striking position, third biasing means for urging said blocking means toward said blocking position and releasing means for moving said blocking means to said releasing position as said cocking and releasing member approaches said second position in response to the movement of said trigger toward its firing position.

11. A firearm as set forth in claim 10 wherein said cocking and releasing element comprises a cocking and releasing cam supported for angular movement between said first and second position and having a first cam lobe for engaging said striker and said releasing means comprises a second cam lobe on said cocking and releasing cam angularly offset from said first cam lobe.

12. A firearm comprising a frame defining a receiver having an arresting surface thereon, a slide supported for reciprocal sliding movement on and relative to the frame between forward and retracted positions, and a firing mechanism for discharging said firearm and including a striker supported by the slide for movement with the slide and relative to the frame and for movement relative to the slide between a fully-cocked position and a striking position corresponding to the discharging position of said firearm, first biasing means for urging said striker toward said striking position, a cocking and releasing element supported on the frame within the receiver for movement between first and second positions, said cocking and releasing element having an abutment surface for engaging said arresting surface when said cocking and releasing element is in its first position to maintain said cocking and releasing element in its first position, second biasing means for urging said cocking and releasing element towards its first position, a trigger assembly for engaging and moving said cocking and releasing element from its first to its second position and including a trigger moveable from an inactive position to a firing position, said striker being moveable into engagement with said cocking and releasing element in said first position and to a half-cocked position intermediate said fully-cocked position and said striking position in response to movement of said slide from said retracted position toward said forward position, said cocking and releasing element in said first position maintaining said striker in said half-cocked position, said striker being moveable from said half-cocked position to said fully-cocked position and releasable from said fully-cocked position for movement to said striking position in response to movement of said trigger to said firing position.

13. A firearm as set forth in claim 12 wherein said cocking and releasing element comprises a rotary cam supported for angular movement about a pivotal axis disposed generally centrally of said cam and said cam has a first cam lobe disposed above said pivotal axis when said cam is in said first position for engaging said striker in its half-cocked position to maintain said striker in its half-cocked position and said abutment surface is disposed below said pivotal axis when said cam is in said first position for engaging said arresting surface in said first position to prevent angular movement of said cam in one angular direction in response to biasing force of said first and second biasing means.

14. A firearm as set forth in claim 13 wherein said first cam lobe is disposed in general vertical alignment with said pivotal axis when said cam is in said first position.

15. A firearm as set forth in claim 13 including disconnecting means for disengaging said trigger assembly from said cocking and releasing element after said striker has been released by said cocking and releasing element and in response to movement of said slide to said retracted position.

* * * * *